United States Patent [19]

Fillmore et al.

[11] Patent Number: 4,723,685

[45] Date of Patent: Feb. 9, 1988

[54] LINED CLOSURE MADE BY THE UNSCREWING PROCESS

[75] Inventors: William E. Fillmore, Toledo; Maximillian Kusz, Waterville, both of Ohio

[73] Assignee: Owens-Illinois Closure Inc., Toledo, Ohio

[21] Appl. No.: 944,897

[22] Filed: Dec. 19, 1986

[51] Int. Cl.[4] ..... B65D 53/04

[52] U.S. Cl. ..... 220/288; 215/220; 215/329; 215/350

[58] Field of Search ..... 215/329, 350; 220/288

[56] References Cited

U.S. PATENT DOCUMENTS

| | | | |
|---|---|---|---|
| 2,039,757 | 5/1936 | Von Till | 215/329 |
| 4,180,175 | 12/1979 | Virog, Jr. et al. | 215/329 |
| 4,381,840 | 5/1983 | Ostrowsky | 215/329 |
| 4,609,114 | 9/1986 | Roy | 215/220 |
| 4,651,886 | 3/1987 | Stull | 215/329 |

*Primary Examiner*—Stephen Marcus
*Assistant Examiner*—Nova Stucker
*Attorney, Agent, or Firm*—H. G. Bruss

[57] ABSTRACT

A two-piece child-resistant closure having a molded plastic inner component and a molded plastic outer component, the inner component having a double ended liner retention bead that projects radially inwardly from the inside of an annular skirt portion to retain a sealing liner in a position that is adjacent to the underside of a top panel portion thereof without the need for an adhesive, the inner portion further having a helically extending thread that projects radially inwardly from the annular skirt portion, the thread having an uppermost portion with a 0° helical angle that is positioned between the spaced apart ends of the double ended liner retention bead to reduce the required vertical spacing between the liner retention bead and the start of the helical thread to permit the closure to be applied to a container with a standard finish portion. The inner component is made by a process in which it is removed form the molding tooling by unscrewing for maximum resistance to stripping from the finish of the container to which it is to be applied.

13 Claims, 8 Drawing Figures

LINED CLOSURE MADE BY THE UNSCREWING PROCESS

BACKGROUND OF THE INVENTION

1. Field Of The Invention

This invention relates to a helically threaded molded thermoplastic closure which is made by the unscrewing process and which incorporates a bead to retain a sealing liner in position against the underside of the top of the closure, to thereby eliminate the need for an adhesive to bond the closure liner to the underside of the closure. More particularly, this invention relates to a closure of the aforesaid character which functions as the inner member of a two-piece child-resistant closure that is used in conjunction with an outer member. The outer member fits over the inner member and cooperates with the inner member to permit the removal of the inner member by the proper manipulation of the outer member in a way which imparts child-resistant opening characteristics to the combined closure.

2. Description Of The Prior Art

As is known in the prior art, molded plastic closures with internal helical threads can be manufactured by a process in which each closure is removed from the molding tooling either by striping the closure from the tooling or by unscrewing the closure from the tooling. Generally speaking, the stripping process is faster and less expensive, but the unscrewing process, while slower and more expensive, can be used to provide the closure with superior resistance to being stripped from the threaded finish of the container to which it is ultimately applied. As is also known in the prior art, it is frequently desirable to provide a helically threaded molded plastic closure, whether made by the stripping process or by the unscrewing process, with a soft pulp or plastic sealing liner on the underside of the top of the closure to permit the closure to properly seal against the rim of the container to which it is ultimately applied. The sealing liner may be adhesively attached to the underside of the top of the closure, unless the contents to be placed into the associated container are chemically incompatible with the type of adhesive that is used in the attachment of the liner to the molded plastic closure. In cases where it is undesirable to use an adhesively attached sealing liner, it is also known that the sealing liner may be suitably retained in place by providing the inside of the skirt portion of the closure with an inwardly projecting bead which, by virtue of providing an interference fit with an outer peripheral portion of the sealing liner, mechanically or frictionally retains the sealing liner in the desired position against or adjacent to the underside of the top of the closure. U.S. Pat. No. 2,039,757 (L.A. VonTill) discloses a molded plastic closure which is made by the stripping process and which incorporates a double ended bead, described as a circumferential ledge, to retain a sealing liner in position against the underside of the top of the closure.

As is explained in the aforesaid U.S. Pat. No. 2,039,757, it is necessary to discontinue the closure liner retention bead over at least a portion of the circumference of such bead to avoid interference with the upper portion of the helical thread on the closure to which the molded plastic closure is to be affixed. Because of this problem of interference between the upper portion of the helical thread on the closure and the liner retention bead of the closure, the use of molded plastic closures with liner retention beads has heretofore largely been limited to use on containers of a type that has a non-standard finish design, that is, to containers of a type that has a finish design with a larger than standard "S" dimension, the vertical dimension between the top of the container rim and the start of the helical thread on the container. Of course, the use of any such container with a non-standard finish portion, especially with a finish portion that has greater vertical height than would be necessary with a standard finish portion, is undesirable in that it adds to the manufacturing cost of such containers and to the manufacturing cost of the closures therefor, and it adds to the cost of applying closures to filled containers on a mass production basis.

The use of a radially inwardly projecting bead for purposes of the retention of the liner of a lined closure is even more difficult in the case of a molded plastic closure which is made by the unscrewing process, since the molded plastic bead does not have a helical angle and, thus, must be stripped from the adjacent portion of the mold tooling notwithstanding the fact that the rest of the closure is being removed from such tooling by unscrewing. This fact limits the radial depth of such liner retention bead, and this limitation is especially severe in the case of closures which are made from unusally hard thermoplastic materials such as PET (polyethylene-terepthalate) or polypropylene, materials which sometimes must be used for purposes of chemical compatibility with the product packaged in the associated container, for example, bleach products and petroleum distillate products.

SUMMARY OF THE PRESENT INVENTION

According to the present invention there is provided a molded plastic closure, or a molded plastic closure inner component for a two-piece child-resistant closure, which is manufactured by a process in which it is unscrewed from the associated molding tooling, which eliminates the need for an adhesive to secure the associated sealing liner against the underside of such closure, or closure inner component, by providing an interrupted radially inwardly projecting bead to retain the sealing liner in place, and which can be applied to a container with a standard finish. The radially inwardly projecting helical thread of such closure, or closure inner component, has a compound thread angle, the uppermost portion of such thread having an angle, with respect to the horizontal when the closure is in its normal use position, which is substantially less than the angle of the lower portion of the thread, the angle of the uppermost portion of the closure thread preferably being 0° with respect to a plane extending transversly through the vertical central axis of the closure in its normal orientation on an upright container. Thus, by having a thread angle of 0° or nearly 0° at the uppermost portion, the interference between the liner retention bead of the closure and the uppermost portion of the closure thread is reduced, thereby permitting a longer arcuate extent for the closure retention bead while eliminating the need to provide a greater than standard vertical spacing between the closure retention bead and the top of the closure thread, and, therefore, avoiding the need for a container which has a greater than standard "S" dimension. Preferably, in the closure or closure inner member according to the present invention, the liner retention bead is discontinued in the region of the uppermost portion of the closure thread, with the discontinued portion having a lesser arcuate extent than would otherwise be necessary if the uppermost portion of the closure helical thread followed the same helical angle as the lower portion of the closure helical thread. Closures, or closure inner components, according to the present invention can be satisfactorily manufactured from exceptionally hard thermoplastic materials such as PET which, because of the chemical durability of such materials and because of the fact that such closures or closure inner components need not have an adhesive to retain the closure liner in place, can be satisfactorily used in the packaging of products such as bleach products, which tend to cause stress-cracking of polypropylene closures, and petroleum distillate products which tend to soften polypropylene closures. Further, because such closures or closure inner components are removed from the molding tooling by an unscrewing process, they are are more resistant to stripping when applied to the finish of a container than would be the case with closures produced by a process in which such closures were stripped from the associated molding tooling.

Accordingly, it is an object of the present invention to provide an improved molded plastic closure having a radially inwardly projecting closure liner retention bead. More particularly, it is an object of the present invention to provide an improved molded plastic closure of the aforesaid character in which such closure has a high degree of resistance to stripping when applied to the finish of a container by virtue of being manufactured by a process in which such closure is removed from the molding tooling by an unscrewing process. Even more particularly, it is an object of the present invention to provide a molded plastic closure of the aforesaid character which can be applied to a container that has a standard finish portion.

It is also an object of the present invention to provide an improved two-piece child-resistant closure in which such closure has an improved molded plastic inner component with a radially inwardly projecting closure liner retention bead. More particularly, it is an object of the present invention to provide a child-resistant closure of the aforesaid character in which such inner component has a high degree of resistance to stripping when applied to the finish of a container by virtue of being manufactured by a process in which such inner component is unscrewed from the associated molding tooling. Even more particularly, it is an object of the present invention to provide a child-resistant closure of the aforesaid character which can be used in conjunction with a container having a standard finish portion.

For a further understanding of the present invention and the objects thereof, attention is directed to the drawing and the following brief description thereof, to the detailed description of the preferred embodiment and to the appended claims.

DETAILED DESCRIPTION OF THE PREFERRED EMBODIMENT

Figure 6:
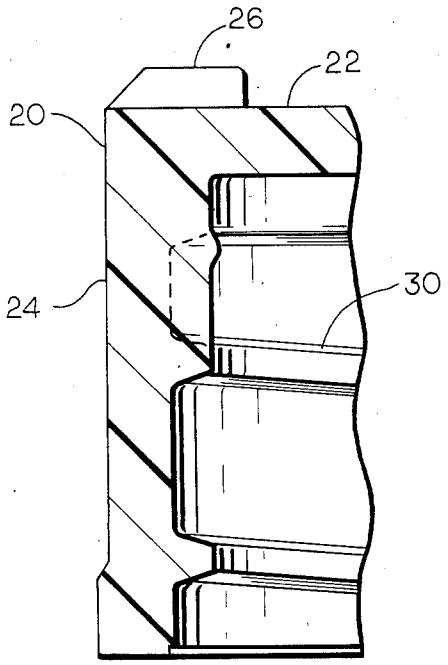
FIG. 6 is a fragmentary sectional view taken on line 6—6 of FIG. 5.
Figure 7:
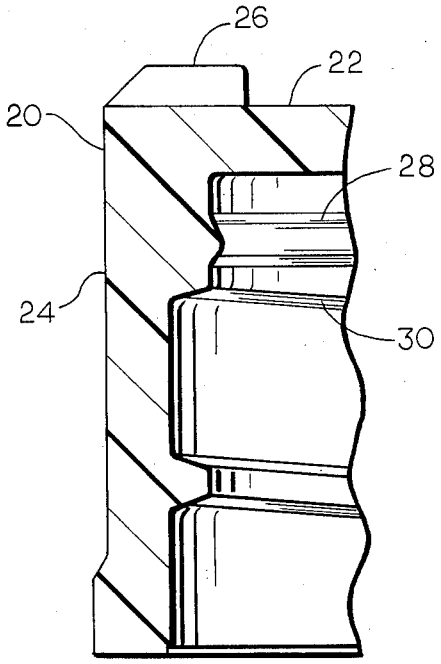
FIG. 7 is a fragmentary sectional view taken on line 7—7 of FIG. 5.
Figure 1:
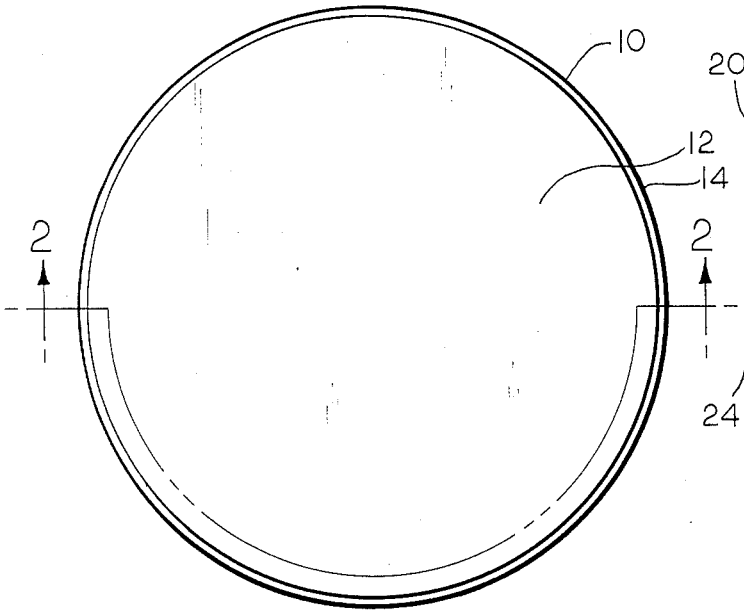
FIG. 1 is a top plan view of a two-piece child-resistant closure according to the preferred embodiment of the present invention.
Figure 3:
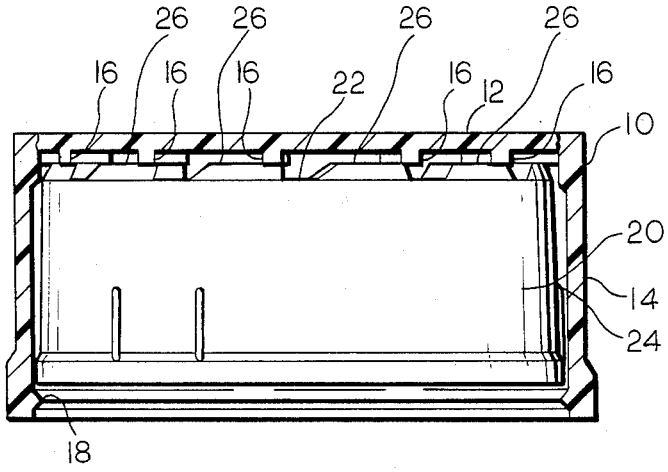
FIG. 3 is a view similar to FIG. 2 which shows the child-resistant closure according to the present invention in which there is slippage between the inner and outer components thereof to prevent removal of such closure from an associated container by a child.
Figure 2:
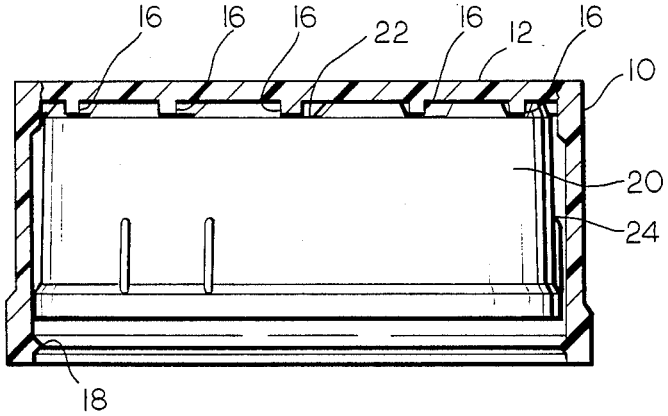
FIG. 2 is a sectional view taken on line 2—2 of FIG. 1.
Figure 4:
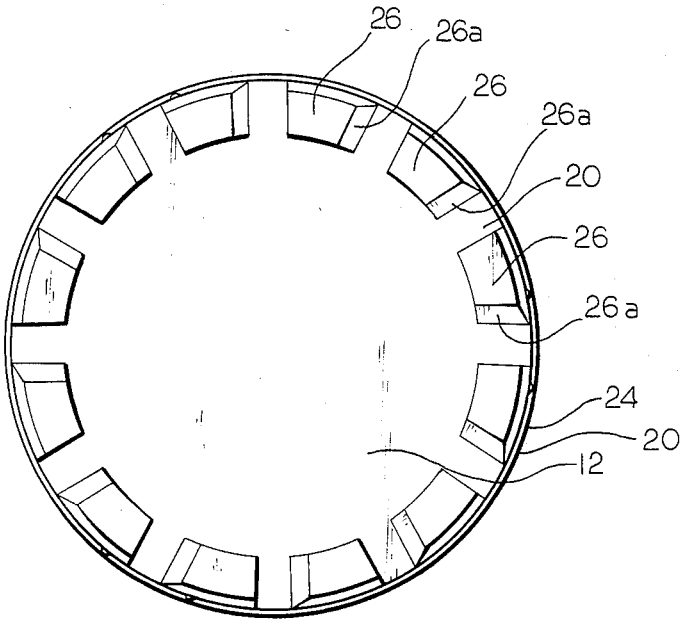
FIG. 4 is a top plan view of the child-resistant closure inner component of FIGS. 1 through 3.
Figure 5:
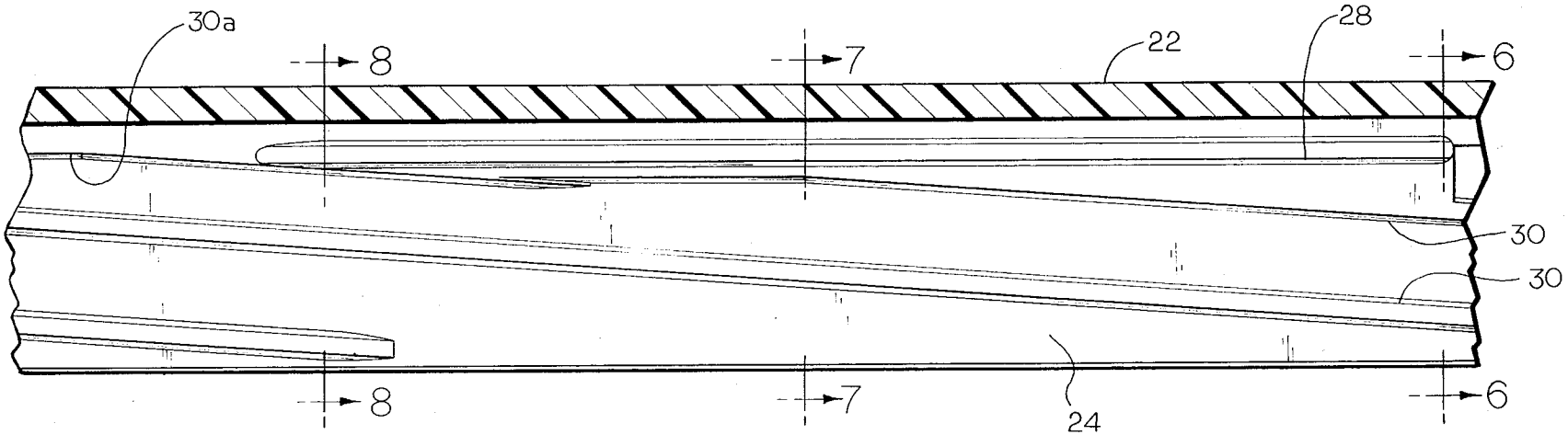
FIG. 5 is a developed view of the inside of the skirt of the closure inner component of FIG. 4.

A two-piece child-resistant closure according to the present invention is illustrated in FIGS. 1 through 3 and is made up of an outer component 10 and an inner component 20. The outer component 10, preferably, is molded from a suitable thermoplastic material such as polypropylene by injection molding or compression molding, and has a top panel portion 12 and an annular skirt 14 which depends downwardly from the top panel portion 12 and which is molded integrally therewith. The inner component 20, as shown, is positioned in the assembled child-resistant closure within the outer component 10, and has a top panel portion 22 which extends transversly of the central axis of the inner component 20 and an annular skirt 24 which depends downwardly from the top panel portion 22. The annular skirt 24 extends parallel to, and is positioned coaxially with, the central axis of the inner component 20. The outer component 10 also has vertical projections 16 projecting from the underside of the top panel portion 12, and the inner component 20 has vertical projections 26 projecting outwardly from the top surface of the top panel portion 22. Each vertical projection 26 of the inner component 20 is provided with an inclined surface **26*a* along the edge which is engaged by the vertical projections 16 of the outer component 10 upon the removal of the inner component 20 from a container (not shown), and the inner component 20 and the outer component 10 are selectively movable axially with respect to one another to permit selective engagement of the vertical projections 16 of the outer component 10 with the vertical projections 26 of the inner component 20. Thus, in attempting to remove the inner component 20 from a container by an unscrewing motion resulting from the turning of the outer component 10, unless the outer component 10 is firmly pressed downwardly against the inner component 20, the vertical projections 16 of the outer component 10 will be cammed upwardly by the inclined surfaces 26*a* of the vertical projection 26, and there will be no unscrewing of the inner component 20 from the associated container, the condition which is illustrated in FIG. 3. The axially relative movement of the inner component 20 within the outer component 10 is limited by an inwardly projecting bead 18 in the annular skirt 14 of the outer component 10 which projects inwardly beyond the circumference of the bottom of the annular skirt 24 of the inner component 20, to thereby ensure that the outer component 10 and the inner component 20** do not separate from one another, after the initial assembly thereof.

Figure 8:
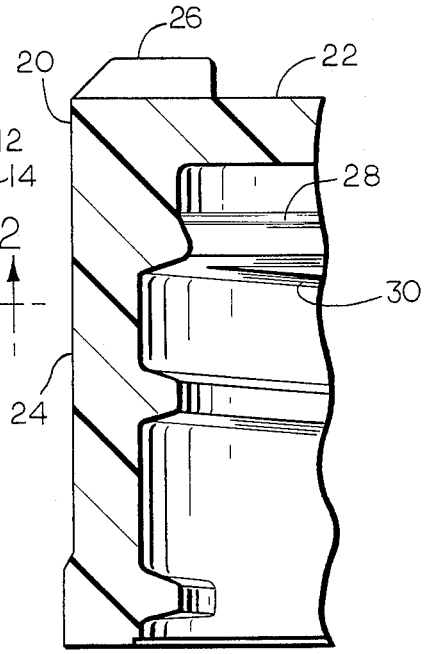
FIG. 8 is a fragmentary sectional view taken on line 8—8 of FIG. 5 with a liner added.

As is shown in FIGS. 5 through 8, the inside of the annular skirt 24 of the inner component 20 is provided with a radially inwardly projecting bead 28 which is positioned beneath the bottom surface of the top panel portion 22 and which is adapted to receive a soft pulp or plastic liner, identified by reference numeral 40 and shown only in FIG. 8 to permit the inner component 20 to sealingly engage the top of the finish portion of an associated container, not known. By the use of such a bead 28 in the inner component 20, it is possible to properly maintain the sealing liner 40 in position with respect to the top panel portion 22 of the inner component 20 without the need for a separate hot melt or other adhesive to adhesively affix such liner to the underside of the top panel portion 22. This is a particular advantage in closures that are intended to be used in the packaging of various organic liquid products such as solvents and petroleum distillates, since such products tend to attack and degrade most types of adhesives that are used in the manufacture of closures.

The inner component 20 of the two-piece child-resistant closure according to the preferred embodiment of the present invention is also provided with a radially inwardly projecting helical thread 30 to permit the inner component 20 to be attached to a helically threaded portion of the associated container by a screwing on motion and to be removed from the associated container by an unscrewing motion. To minimize the vertical height of the inner component 20 of the two-piece child-resistant closure according to the present invention, and to thereby minimize the vertical height, or "S" dimension of the finish of the associated container, the bead 28 of the inner component 20 is discontinued for a portion of its circumferential extent in the region where it is in vertical alignment with an upper portion 30*a* of the helical thread 30 where the helical angle is preferably 0° to avoid interference between the bead 28 and such upper portion 30*a* of the helical thread 30. Preferably, the bead 28 of the inner component 20 will have an arcuate extent of at least 240°, and, ideally, approximately 278° plus runout, an extent which is fully satisfactory for purposes of retaining a sealing liner against the underside of the top panel portion 22, and which, in conjunction with a helical thread having a total circumferential extent of approximately 540° including an upper portion 30*a* with a 0° helical angle of approximately 75°, is sufficient to ensure that a 28—millimeter closure according to the present invention can be satisfactorily applied to and removed from a container which has a standard finish portion such as, in the case of a 28 millimeter glass container, a GPI (Glass Packaging Institute) 400 finish.

The inner component 20 of the two-piece child-resistant closure according to the present invention is preferably manufactured by a process in which it is unscrewed from the core pin portion of the molding tooling to provide such closure inner component 20 with maximum resistance to inadvertent removal from the finish portion of the associated container by stripping, and, when such inner component 20 is removed from the molding tooling by unscrewing, the bead portion 28 must, nevertheless, be stripped from the portion of the tooling which is used to form such bead portion because of the fact that it does not extend on a helical angle with respect to the vertical central axis of the inner component 20. Thus, this necessary stripping of the bead 28 imposes limitations on the radial extent of the bead 28, and these restrictions are particularly severe in the case of an inner component 20 which is molded from a particularly hard thermoplastic material such as PET (polyethylene-terepthalate) which is a type of material that is the preferred material for many packaging applications, such as the packaging of bleach products and the packaging of petroleum distillate products which are not chemically compatible with various other types of thermoplastic materials that are available for use in the manufacture of such inner components 20, such as polypropylene. To help minimize the needed radial extent of the bead 28 which should, preferably, be from 0.005 in. -0.015 in. and, ideally, about 0.010 in., the inner component 20, preferably, is provided with an "E" dimension, that is, the inside diameter of the annular skirt 24 at the root of the helical thread 30, in the lower part of the annular skirt 24, which is near the maximum permitted "E" dimension for the packaging application, and with an "E" dimension near the top of the annular skirt 24 which is near the minimum permitted "E" dimension for such closure. This can be done in connection with the manufacture of a molded plastic closure that is to be applied to the finish of a glass container since the dimensional specifications for the closure are dictated by the dimensional specifications of the associated container, and since the manufacturing processes for glass containers, are, dimensionally, considerably less precise than the injection molding or compression molding processes which are available for the manufacture of the inner component 20. Further, for optimum removal of the inner component 20 from the molding tooling by unscrewing while providing for good retention of a liner between the top of the bead 28 and the underside of the top panel portion 22, the top surface of the bead 28 should extend at an angle of 20° to 50° in a plane which extends along the central axis to the inner component, and preferably at an angle of about 30° in such plane.

While the invention has been described in connection with a two-piece child-resistant closure, it would, of course, be obvious to one of ordinary skill in the art that the inner component 20 itself could function as a one-piece closure in situations where child-resistant opening characteristics were undesirable or unnecessary, in which case it would be unnecessary to provide such one-piece closure with vertical projections extending from the upper surface of the top panel corresponding to the vertical projections 26 of the inner component 20 of a two-piece child-resistant closure.

Although the best mode contemplated by the inventors for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. A molded plastic closure having a central axis for sealingly engaging a helically threaded finish portion of a container, the finish portion of the container terminating in a rim, said closure comprising:

a top panel portion having a top side and a bottom side, said top panel portion being adapted to span the finish portion of the container and extending transversly of said central axis; and an annular skirt having an outside and an inside, said annular skirt extending from said top panel portion in a direction which is generally parallel to and coaxial with said central axis, said annular skirt being adapted to surround at least a portion of the finish portion of the container and comprising:

helically extending thread means projecting radially inwardly from said inside of said annular skirt, said helically extending thread means being adapted to engage the helically threaded finish portion of the container to permit said closure to be applied to the container by a screwing action and to be removed from the container by an unscrewing action, said helically extending thread means having a first portion and a second portion, said first portion being positioned closer to said top panel portion of said closure than said second portion and extending at a first helical angle with respect to a plane extending transversly of said central axis of said closure, said second portion extending at a second helical angle with respect to said plane, said first helical angle being less than said second helical angle; and radially inwardly projecting bead means positioned between said second portion of said helically extending thread means and said bottom side of said top panel portion, said radially inwardly projecting means being spaced from said bottom side of top panel portion and being adapted to engage a sealing liner in a position adjacent to said bottom side of said top panel portion without the need for an adhesive to retain the sealing liner in the position adjacent to said bottom side of said top panel portion, the sealing liner being adapted to form a seal against the rim of the finish portion of the container when said closure is tightly applied to the container, said radially inwardly projecting bead means further having a first end and a second end which is circumferentially spaced from said first end, each of said first end and said second end of said radially inwardly projecting bead means being positioned adjacent to said first portion of said helically extending thread means.

2. A molded plastic closure according to claim 1 in which said top panel portion and said annular skirt are integrally molded in a single piece from a hard thermoplastic material.

3. A molded plastic closure according to claim 2 in which the principal ingredient of said thermoplastic material is selected from the group consisting of polypropylene and PET.

4. A molded plastic closure according to claim 3 in which said radially inwardly projecting bead means has a circumferential extent between said first end and said second end of less than 360°.

5. A molded plastic closure according to claim 4 wherein said radially extending bead means is positioned in a plane that extends transversly of said central axis of said closure.

6. A molded plastic closure according to claim 5 wherein said radially extending bead means comprises a continuous bead extending circumferentially from said first end to said second end.

7. A molded plastic closure according to claim 6 wherein said radially inwardly projecting bead means projects radially inwardly from said inside of said annular skirt by a distance in the range of 0.005 in. to 0.015 in.

8. A molded plastic closure according to claim 7 wherein said distance is approximately 0.010 in.

9.. A molded plastic closure according to claim 6 wherein said circumferential extent of said radially inwardly projecting bead means is at least approximately 240°.

10. A molded plastic closure according to claim 9 wherein said circumferential extent is approximately 278° plus runout.

11. A molded plastic closure according to claim 5 wherein said radially extending bead means has a top surface that extends inwardly and downwardly from said inside of said annular skirt, said top surface being disposed at an angle, in a plane that extends along said central axis, in the range of 20° to 50°.

12. A molded plastic closure according to claim 11 wherein said angle is approximately 30°.

13. A molded plastic closure according to claim 4 wherein said first helical angle is approximately 0° and wherein said first portion of said helically extending thread means has a circumferential extent of approximately 75°.

* * * * *